United States Patent [19]

Hartline et al.

[11] Patent Number: 4,918,770

[45] Date of Patent: Apr. 24, 1990

[54] SOFA BED WITH CLOSING AND OPENING ASSIST

[75] Inventors: Michael F. Hartline, Saltillo; Nikki O. White, Tupelo, both of Miss.

[73] Assignee: Super Sagless Corp., Tupelo, Miss.

[21] Appl. No.: 281,182

[22] Filed: Nov. 21, 1988

[51] Int. Cl.[5] ..... A47C 17/04

[52] U.S. Cl. ..... 5/13; 5/29

[58] Field of Search ..... 5/13, 29, 31–36, 5/51 R, 51 G, 51 J, 51 K, 51 M

[56] References Cited

U.S. PATENT DOCUMENTS

| | | | |
|---|---|---|---|
| 2,749,559 | 6/1956 | Petersen | 5/13 |
| 2,817,100 | 12/1957 | Bruin | 5/13 |
| 3,005,211 | 10/1961 | Pokorny | 5/13 |
| 3,041,634 | 7/1962 | Willis | 5/13 |
| 3,292,188 | 12/1966 | Gerth | 5/13 |
| 4,035,852 | 7/1977 | Cycowicz | 5/13 |
| 4,592,102 | 6/1986 | Mizelle | 5/13 |

FOREIGN PATENT DOCUMENTS

| | | | |
|---|---|---|---|
| 671324 | 10/1963 | Canada | 5/13 |

*Primary Examiner*—Gary L. Smith
*Assistant Examiner*—F. Saether
*Attorney, Agent, or Firm*—Wolf Greenfield & Sacks

[57] ABSTRACT

A sofa bed having a foldable bed frame including a main section, center section and front section which are coplanar with one another when the frame is in the bed configuration. A mattress is supported by the foldable frame and folds with it when the bed is closed or stored in the sofa frame. When the foldable bed frame is partially folded, the front section does not fully compress the mattress between the main and front sections. When the partially folded bed frame is moved to the fully folded position inside the sofa frame, a series of links causes the front section of the bed frame to move to a horizontal position and fully compress the mattress. In this fashion, the stored energy in the mattress is reduced when the frame is partially open so as to reduce the possibility of injury to the operator.

5 Claims, 3 Drawing Sheets

SOFA BED WITH CLOSING AND OPENING ASSIST

INTRODUCTION

This invention relates to sofa beds and more particularly to sofa bed frames which when closed or retracted are in the sofa configuration and when open or extended are in the bed configuration.

Sofa beds have enjoyed substantial increases in sales as the higher costs of housing has resulted in smaller dwelling units. With their increased popularity, substantial development has been directed to making sofa beds more comfortable both in the sleeping and seating configurations. One rather obvious method of increasing sleeping comfort is to provide sofa beds with thicker and firmer mattresses. However, the thicker and firmer mattresses create sofa bed closing and opening problems. In particular, one such problem results from the great force required to fold the mattress while closing the sofa bed frame. The compression force can be as high as 100 pounds and can make it quite difficult for the operator to completely close the frame. Another problem results from the stored energy of the mattress when the sofa bed is being opened into its bed configuration. While in the process of opening the locked front section of the frame, the stored energy of the compressed mattress is released, which may cause the front section comprising the front tube and front leg to swing rapidly toward the operator with sufficient force to cause serious injury.

The principle object of the present invention is to provide means incorporated into the sofa bed frame, which greatly reduces the compression force required to fold the foot end of the mattress during the initial closing phase of the sofa bed.

Another object of the present invention is to provide means incorporated into the sofa bed frame, which greatly reduces the stored energy of the compressed mattress when the sofa bed is partially open with the foot end folded.

Yet another object of the present invention is to utilize some of the gravitational forces available as the sofa bed is being folded from the partially folded position to the fully stored position (seating configuration) to compress the foot end of the mattress.

To accomplish these and other objects of the present invention, a pull link is incorporated into the frame, which utilizes the operating forces generated while fully closing the sofa bed from the partially closed configuration to compress the mattress. The frame does not fully compress the mattress when the foot end is folded over during the initial phase of the storing operation. Upon opening the sofa bed, the pull link reduces the compression forces exerted on the mattress as it is converted from the fully to the partially closed configuration. This allows the mattress to release a substantial amount of stored energy. Therefore, the likelihood of the front section swinging rapidly toward the operator when the sofa is fully opened is greatly reduced.

These and other objects and features of the present invention will be better understood and appreciated from the following detailed description of one embodiment thereof read in connection with the accompanying drawings.

DETAILED DESCRIPTION

Figure 1:
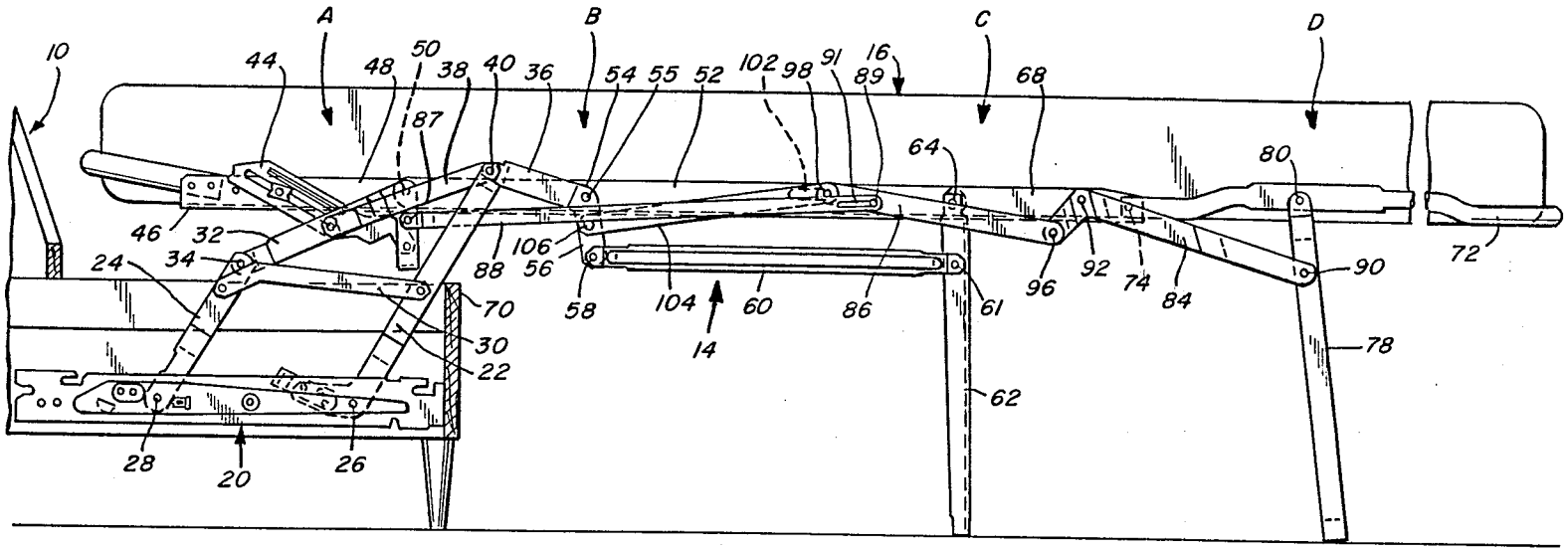
FIG. 1 is a fragmentary side elevation view of a sofa bed constructed in accordance with this invention and shown with the bed frame in its opened or bed configuration.

The sofa bed shown in the drawings includes a conventional back rest 10 and arms 12 which in turn support the sofa bed frame 14. When the sofa bed frame 14 is closed, or in the sofa configuration as in FIG. 3, seat cushions 15 rest on the top of the inverted front portion of the sofa bed frame in the conventional manner. In addition, the sofa bed frame contains a mattress 16 which is folded within the sofa and bed frame when the frame is closed or retracted. The mattress rests on a support (not shown) attached between the sides of the frame. The support typically is made up of wire or fabric or a combination of both. When the sofa bed frame 14 is opened to the bed configuration of FIG. 1, the mattress unfolds to provide a comfortable horizontal platform for sleeping.

Figure 2:
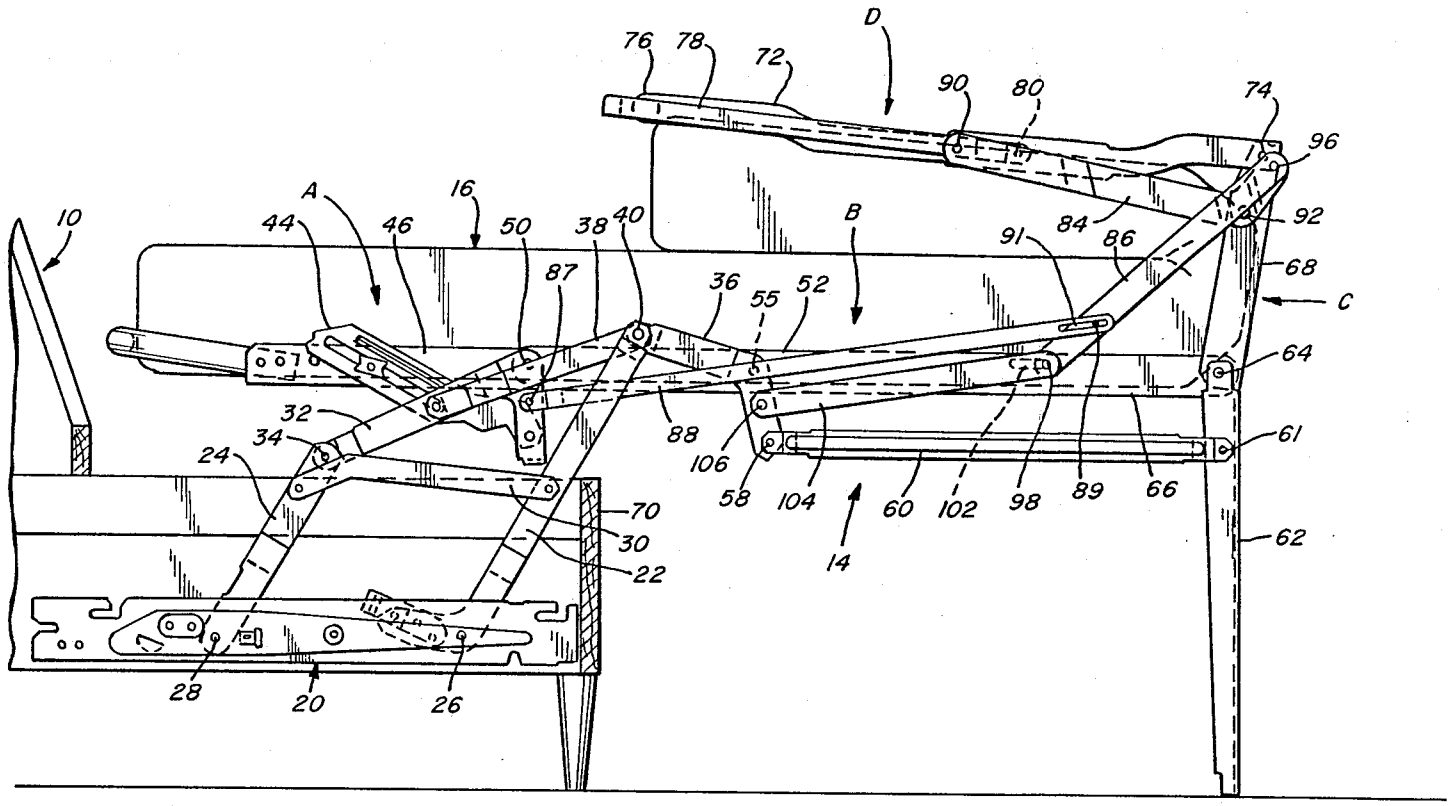
FIG. 2 is a fragmentary side elevation view of the sofa bed shown in FIG. 1 but with the bed frame in its partially opened configuration.
Figure 3:
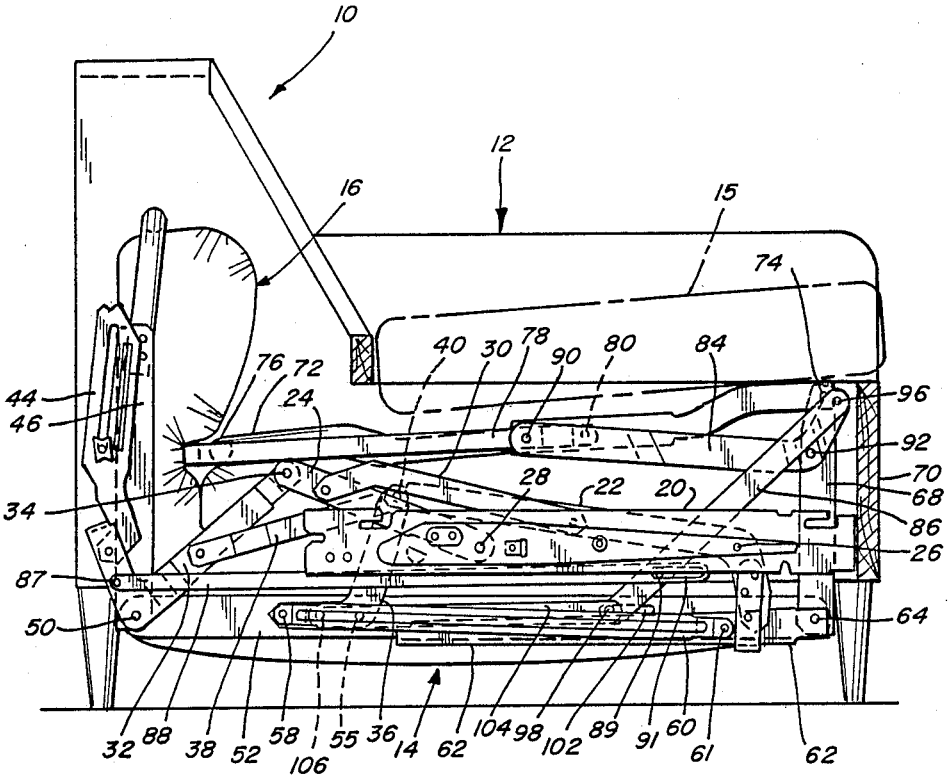
FIG. 3 is a side elevation view of the full sofa but showing the bed frame in its closed or sofa configuration.

The sofa bed frame 14 has a rear section A which supports the head of a person sleeping on the mattress 16, a main section B which supports the torso, a narrow center section C which separates the main section B from a front section D when the frame is folded, and the front section D which supports the legs. When the frame is open, all four sections lie in the same plane and provide an appropriate mattress support as in FIG. 1. When the frame is to be closed, the front section D is first folded back above the main section B, and the center section C extends upwardly at the front end between the two sections B and D as shown in FIG. 2. It will be noted in FIG. 2 that the front portion of the mattress 16 between sections B and D of the frames is not fully compressed, as the section D extends upwardly away from Section B in that position. Thereafter, the folded front end is lifted so as to tilt the rear section A into the sofa between the arms, and the folded front section is then pushed rearwardly causing the rear section A to extend upwardly into the backrest and the sections B, C and D to lie between the arms and behind the front rail 70 of the sofa as shown in FIG. 3. In the closed position of FIG. 3, the front portion of the mattress is fully compressed between sections B and D of the frame, as section D is essentially horizontal and parallel to the section B and in position to support the seat cushion 15.

The sofa bed frame 14 is secured to the inside of the sofa arms 12 by means of a pair of chassis links 20 conventionally bolted in place, one of which is shown in each of the drawings. In the following descriptions, one side only of the sofa bed frame will be described, and it will be appreciated that a duplicate arrangement is provided on each side of the sofa.

The chassis link 20 carries front and rear pivot links 22 and 24 that are connected to the chassis link 20 by rivets 26 and 28, respectively. The front and rear pivot links 22 and 24 are in turn connected intermediate their ends by rear link 30. The upper end of the rear pivot link 24 is pivotally connected to the rear swing link 32 by rivet 34 while the upper end of the front pivot link 22 is connected to one end of a bell crank 36 and the front end of drive link 38, by rivet 40. The rear section A of the sofa bed frame includes a latch link 44 and rear side angle 46, which together with rear swing link 32 function in the conventional manner and enable the rear portion of the sofa bed frame along with the rear end of the mattress to fold upwardly into the back rest 10 as shown in FIG. 3 when the frame 14 is fully retracted to the sofa configuration. Latch link 44 also allows the rear angle 46 to be elevated to a TV position (not shown) when the frame 14 is opened to the bed configuration. Because the mechanism thus far described is well known in the art, and because the details form no part of the present invention, they need not be described in greater detail.

As best illustrated in FIG. 1, the rear side angle 46 forming part of rear section A is pivotally connected at its front end 48 by rivet 50 to the main angle 52 of the main section B. The main angle 52 in turn pivotally supports the bell crank 36 by rivet 55 at its bend 54, and the bell crank 36 is connected at its end 56 by rivet 58 to the rear end of the rear leg control link 60. The front end of the rear leg control link 60 is pivotally connected by rivet 61 to the rear leg 62 which is pivotally connected by rivet 64 to the front end of the main angle 52. The main section of the sofa bed frame 14 disposed within the main angles 52 (one on each side of the frame) supports the torso of the person reclining on the bed assembly when the sofa bed frame 14 is open.

The front end 66 of the main angle 52 is also pivotally connected to the center angle 68 of center section C by the rivet 64. The center angle 68 is shown in FIG. 3 to be disposed perpendicular to the main angle 52 when the sofa bed frame 14 is in the retracted or sofa configuration. As shown in FIG. 2, the central angle 68 and center section C ar disposed at a slight angle to the vertical (inclined forwardly) when the sofa bed frame is partially withdrawn from the sofa with the mattress 16 and main angle 52 extending over the front rail 70 of the sofa. The other end of the center angle 68 in turn is pivotally connected by rivet 74 to the front tube 72 which defines the front section D of the frame. The sides of the front tube 72 may be integrally formed with the transversely extending section 76 as suggested in FIG. 2. If made in that manner, the front tube ties the two sides of the frame 14 together. It will also be appreciated that cross members (not shown) and mattress supports (not shown) join the two sides of the frame 14 and permit the frame to close and open as described.

Front leg 78 of the sofa bed frame 1 is pivotally connected by rivet 80 to the front tube 72 intermediate the front and back ends of the front tube. The front leg 78 in turn is operated by a front leg lock link 84, lock link 86, and pull link 104. The front leg lock link 84 is connected by rivet 90 to the front leg 78 and carries a rivet 92 intermediate its ends that pivots on the center angle 68. The other end of the front leg locklink 84 is connected by rivet 96 to one end of the lock link 86. The other end of lock link 86 in turn is connected to the front end of the pull link 104 by rivet 98 which is slidably mounted within a slot 102 in main angle 52. Rivet 106 connects the rear end of pull link 104 to the bell crank 36 intermediate its bend 54 and end 56. A control link 88 having a slot 91 at one end, is slidably connected intermediate the ends of lock link 86 by rivet 89 (see FIG. 2). The other end of the control link 88 is connected to the rear swing link 32 by rivet 87. The control link is an anti tipping device but is not necessary to the operation of the present invention.

To move the frame from the bed configuration as shown in FIG. 1 to the intermediate position as shown in FIG. 2, the operator raises and rotates the front tube 72 that defines the front section D, about rivet 74. This motion causes the front leg 78 to pivot about rivet 80 to a position essentially coplanar with the front tube 72. It will be noted in FIG. 2 that the front section D including the front tube is not folded to a horizontal position but rather extends upwardly slightly so that the mattress 16 is not fully compressed. The center section C including center angle 68 also is pivoted upwardly during the this step about rivet 64, but it is not positioned perpendicular to the main angle 52 as when a conventional sofa bed frame is folded. A compression force as high as a 100 lbs. is normally required with conventional sofa bed frames to fully compress the mattress and bring the front tube 72 and front leg 78 into a horizontal position parallel to the main angle 52. This position is necessary to convert the frame to the sofa configuration fully folded within the sofa behind the front rail 70. The present invention reduces the compression force required of the operator during the initial folding step by limiting the forward travel of the front tube in this stage and by completing the folding of the front tube during the second step in the frame storing process. In this way, the stored energy in the mattress is reduced during the initial stage of storing the bed frame within the sofa so as to eliminate the dangers of the prior art sofas. The mattress is only fully compressed as it is lifted over the sofa front rail 70 and stored within the sofa frame. The delayed compression of the mattress is accomplished by the pull link 104 as is described fully below.

As is partially evident in the FIGS. 1 and 2, the lock link 86 is slidably connected to both the control link 88 and the pull link 104 by means of rivet 89 slidable within slot 91 of the control link 88 and rivet 98 slidable within slot 102 in the main angle 52. When the frame 14 is in the bed configuration, the rivets 89 and 98 of the lock link 86 are positioned at the right ends of the slots 91 and 102, respectively, as viewed in FIG. 1. When the frame is brought into the first fold position by raising the front tube 72, rivet 98 remains at its position at the right end of slot 102 and rivet 89 moves to a position intermediate the ends of slot 91. As evident in FIG. 2 the mattress is not fully compressed when the frame 14 is in its first fold position.

To move the frame from the intermediate position as shown in FIG. 2 to the closed or sofa configuration as shown in FIG. 3, the operator lifts the center section C of the frame defined by the two center angles 68, which drops the rear section A including rear angle 46 down into the sofa frame. The operator then pushes on the center section center angles 68, which forces the rear side angles 46 up and behind the back rest of the sofa as shown in FIG. 3. During this closing operation, the bell crank 36 rotates clockwise about rivet 40 which forces the pull link 104 to move to the left as shown in FIG. 3. Under the influence of the bell crank 36, the pull link 104 pulls the lock link 86 to the left causing rivet 98 to slide to the left end of slot 102 in main angle 52. Rivet 89 which connects the control link 88 and lock link 86 is caused to move to the left end of slot 91 as shown in FIG. 3. As lock link 86 moves to the left it causes the front leg lock link 84 to rotate counterclockwise about rivet 92 on the center angle 68, which forces the from leg 78 and front tube 72 to pivot downwardly and compress the mattress 16, as viewed in FIG. 3. At the same time, the center angle 68 is pulled to the vertical position. The pivotal movement of the front tube 72 occurs about rivets 64 and 74. This action fully compresses the mattress between the sections B and D. The pivoting of bell crank 36 about rivet 40 also causes the control link 60 to move to the left as viewed in FIGS. 2 and 3, which causes the rear leg 62 to pivot clockwise about rivet 64 to a horizontal position immediately adjacent the main angle 52. When seat pillows 15 are placed on top of the front section D the sofa bed is ready to be used as a sofa.

To open the closed sofa bed to the bed configuration, the operator removes the seat pillows 15 from their position above front section 72 and pulls the center angle 68 up and to the right from the position of FIG. 3 to lift the bed frame on the pivot links 22 and 24 out of the sofa frame 14 and over the front rail 70. This action causes the bell crank 36 to pivot counterclockwise about rivet 40, which forces the rear leg control link 60 to the right and causes the rear leg 62 to pivot counterclockwise about rivet 64 to a substantially vertical position resting on the floor as shown in FIG. 2. The action of the bell crank 36 also allows the pull link 104 to move to the right as rivet 98 slides to the right in slot 102 and pushes upwardly on lock link 86, causing it to pivot clockwise slightly on rivet 92. As this occurs, rivet 89 on lock link 86 slides to the right of slot 91 in control link 88. The upward movement of lock link 84 releases a substantial amount of stored energy in the compressed mattress 16. The release of this stored energy greatly reduce the potential for injury to the operator when he or she continues the opening operation by swinging the front tube from the intermediate position shown in FIG. 2 to the fully open position shown in FIG. 1.

From the foregoing description, it will be appreciated that by an inexpensive addition to an otherwise conventional sofa bed frame 14 a much safer sofa bed is provided free of the dangerous stored energy in the mattress when the frame is partially open, and thus reducing the possibility of injury to the operator. The device works efficiently without significant added manufacturing costs, and a sofa bed results that is easier to operate than the prior art.

Having described this invention in detail, those skilled in the art will appreciate that many modifications may be made of this invention without departing from its spirit. Therefore, it is not intended that the breadth of this invention be limited to the specific embodiment illustrated and described. Rather, it is intended that the scope of this invention be determined by the appended claims and their equivalents.

What is claimed is:

1. A sofa bed frame supporting a mattress and movable between a closed or sofa configuration, a partially open configuration and a fully open or bed configuration comprising a main angle and a rear leg for supporting the front end of the main angle when the frame is in the bed configuration, a center angle pivotally connected at one end to the front end of the main angle, said center angle being coplanar with the main angle when the frame is in the bed configuration and substantially perpendicular to the main angle when the frame is in the sofa configuration, a front tube pivotally connected to the other end of the center angle and being generally coplanar with the main and center angles when the frame is in the bed configuration and lying in a plane substantially parallel to and spaced above the main angle when the frame is in the sofa configuration, a front leg pivotally connected to the front tube for supporting the front tube when the frame is in the bed configuration, a front leg lock link pivotally connected intermediate its ends to the center angle and pivotally connected at one end to the front leg, a rear leg control link pivotally connected at one end to the rear leg, a lock link pivotally connected at one end to the other end of the front leg lock link and slidably connected at its other end to the main angle, a pull link pivotally connected at one end to the other end of the lock link, and actuating means including a crank directly connected to the pull link and the rear leg control link and responsive to the frame being moved from the closed to the partially open configuration for causing the pull link to pivot the front tube upwardly slightly on the center angle so as to relieve pressure on the mattress folded between the main angle and the front tube and also for causing the rear leg control link to lower the rear leg to a position to support the front end of the main frame, responsive to the frame being moved from the partially open to the closed configuration for causing the pull link to pivot the front tube downwardly toward the main angle so as to compress the mattress folded between them and also for causing the rear leg control link to raise the rear leg to a stored position.

2. A sofa bed frame as defined in claim 1 wherein the crank is pivotally mounted intermediate its ends on the main angle.

3. A sofa bed frame supporting a mattress and movable between a closed or sofa configuration, a partially open configuration and a fully open or bed configuration comprising a main angle and a rear leg for supporting the front end of the main angle when the frame is in the bed configuration.

a center angle pivotally connected at one end to the front end of the main angle, said center angle being coplanar with the main angle when the frame is in the bed configuration and substantially perpendicular to the main angle when the frame is in the sofa configuration, a front tube pivotally connected to the other end of the center angle and being generally coplanar with the main and center angles when the frame is in the bed configuration and lying in a plane substantially parallel to and spaced above the main angle when the frame is in the sofa configuration, a front leg pivotally connected to the front tube for supporting the front tube when the frame is in the bed configuration, a generally horizontal slot in the main angle having front and rear ends, a front leg lock link pivotally connected intermediate its ends to the center angle and pivotally connected at one end to the front leg, a lock link pivotally connected at one end to the other end of the front leg lock link and slidably connected at its other end in the slot of the main angle, a pull link pivotally connected at one end to the other end of the lock link, actuating means including a crank connected to the pull link and responsive to the frame being moved from the closed to the partially open configuration for moving the said other end of the lock link from the rear end to the front end of the slot causing the pull link to pivot the front tube upwardly slightly on the center angle so as to relieve pressure on the mattress folded between the main angle and the front tube and responsive to the frame being moved from the partially open to the closed configuration moving the said other end of the lock link from the front end to the rear end of the slot for causing the pull link to pivot the front tube downwardly toward the main angle so as to compress the mattress folded between them, and said other end of the lock link remains stationary in the front end of said slot as the frame is moved between the partially opened and the fully opened configurations.

4. A sofa bed as defined in claim 3 wherein the front leg lock link is pivoted intermediate its ends to the center section.

5. A sofa bed frame as defined in claim 3 wherein a rear leg link is connected between the crank and the rear leg for moving the leg between operative and inoperative positions as the frame moves between the partially open and closed positions.

* * * * *